United States Patent [19]

Joshi et al.

[11] Patent Number: 4,928,481

[45] Date of Patent: May 29, 1990

[54] STAGED LOW NOX PREMIX GAS TURBINE COMBUSTOR

[75] Inventors: Narendra D. Joshi, Phoenix, Ariz.; Frederick E. Moreno, Los Altos, Calif.

[73] Assignee: PruTech II, San Jose, Calif.

[21] Appl. No.: 218,252

[22] Filed: Jul. 13, 1988

[51] Int. Cl.[5] ..... F23R 3/32

[52] U.S. Cl. ..... 60/737; 60/748; 60/760; 60/753

[58] Field of Search ..... 10/732, 733, 737, 748, 10/759, 760, 753; 431/175, 176

[56] References Cited

U.S. PATENT DOCUMENTS

| | | | |
|---|---|---|---|
| 2,926,495 | 3/1960 | Benson et al. | 60/759 |
| 3,872,664 | 3/1975 | Lohmann et al. | 60/759 |
| 3,981,675 | 9/1976 | Szetela | 60/753 |
| 4,073,134 | 2/1978 | Koch | 60/748 |
| 4,112,676 | 9/1978 | DeCorso | 60/753 |
| 4,805,411 | 2/1989 | Hellat et al. | 60/737 |

FOREIGN PATENT DOCUMENTS

| | | | |
|---|---|---|---|
| 301145 | 11/1954 | Switzerland | 60/748 |
| 2150277 | 6/1985 | United Kingdom | 60/737 |

OTHER PUBLICATIONS

*Premixing Gas and Air to Reduce NOx Emissions with Existing Proven Gas Turbine Combustion Chambers,* by B. Becker, P. Berenbrink and H. Brandner; The American Society of Mechanical Engineers (1986).

*NOx Reduction for Small Gas Turbine Power Plants,* by Solar Turbines Incorporated (1987), pp. S-1 to S-9.

*Gas Turbine Combustion,* by Arthur H. Lefebvre, Thermal Sciences and Propulsion Center, School of Mechanical Engineering, Purdue University, West Lafayette, Indiana, pp. 492-498, (1983).

*Primary Examiner*—Louis J. Casaregola
*Assistant Examiner*—Timothy S. Thorpe
*Attorney, Agent, or Firm*—Flehr, Hohbach, Test, Albritton & Herbert

[57] ABSTRACT

In a staged low NOx lean premix hot wall gas turbine combustor, the interior wall of the combustor is maintained at or near the flame temperature to provide stable operation over a wide range of heat release values. One or more stages of the staged combustor includes a Stirred Reactor region followed by a Plug Flow Reactor region. In one embodiment, a lean premixture of fuel and air is inducted tangentially into an annular intake manifold for inducting a cyclonic flow of the premixture into the combustion chamber. In another embodiment, the Stirred Reactor region is developed by colliding, preferably head-on, a plurality of jets of lean premixture within the combustion chamber.

20 Claims, 6 Drawing Sheets

STAGED LOW NOX PREMIX GAS TURBINE COMBUSTOR

BACKGROUND OF THE INVENTION

The present invention relates in general to staged low NOx lean premix gas turbine combustors and, more particularly, to such combustors wherein the inside wall of the combustor is maintained at or near the flame temperature within the combustor.

DESCRIPTION OF THE PRIOR ART

Nitrogen oxides (NOx) are a combustion-generated air pollution that can contribute to photochemical smog. NOx is formed from two combustion sources: "fuel NOx" (which arises from nitrogen in the fuel being preferentially converted to NOx) and "thermal NOx" (which is formed when high temperatures in the combustion process lead to oxygen and nitrogen in air combining to form NO). The focus of the present invention is on improvements in a method to control thermal NOx.

The preferred technique to control thermal NOx is to lower the temperature of the combustion process. Analytical and experimental work has shown that thermal NOx formation rates in flames increases sharply if local flame temperatures ("hot spots" within the flame envelope) exceed about 2800° F. Therefore, lowering the flame temperature results in reduced NOx formation.

In gas turbines, air is compressed to pressures ranging from 4 to 30 atmospheres, and then a portion is directed to one or more combustors where fuel is added and burned. The balance of the air is then mixed with the combustor discharge to produce a mixed stream having a temperature suitable for the nozzle and turbine stages of the gas turbine (temperatures typically between 1500° F. and 2300° F.). Because the air leaving the compressor and entering the combustor is at elevated temperatures (due to the heat of compression), the resulting peak flame temperature in the gas turbine combustor is high, and this leads to the formation of considerable thermal NOx even when burning clean fuels containing no nitrogen, such as natural gas.

Because gas turbines operate with high levels of "excess air" (that is, there is much more air discharged from the compressor than is needed to burn all the fuel), it is tempting to develop a strategy that uses the excess air to act as a diluent that can absorb a portion of the heat liberated by the combustion process, to reduce the peak flame temperature, and thus reduce NOx emissions. To prevent localized hot spots, the air and fuel must be thoroughly mixed prior to combustion so that there are no "fuel rich zones" (regions where the air/fuel mixture is near stoichiometric) that will result in high localized temperatures.

The amount of "leanness" with which a combustor typically operates is generally characterized by the Equivalence Ratio, ER. Equivalence ratio divides the air/fuel ratio required for "stoichiometrically correct" combustion (combustion in which all the fuel is burned and all oxygen is consumed) by the air/fuel ratio in the combustor. Thus, if a combustor is operating with twice as much air as required to burn all the available fuel (also termed 100% excess air), the ER is 0.5. Typically, industrial combustors operate with minimum excess air to minimize stack losses, so that typical ranges in industrial applications are ER from 0.8 to 0.95 for lean premix combustors in gas turbines operating with preheated combustion air, the desired range for minimum NOx formation is Equivalence Ratio lower than 0.6.

Combustion that uses excess air mixed with the fuel prior to induction into the combustion chamber to reduce flame temperature is termed "lean premix combustion", and has been the subject of research at numerous locations.

It is known from the prior art to provide a lean premix gas turbine combustor in which fuel and air are premixed in a swirler at the end of a cylindrical metal combustion chamber and the lean premixture of fuel and air is inducted into the combustor from one end coaxially of an igniter which ignites the lean mixture. The cylindrical metal wall is cooled by being perforated having cooling members inside over which is drawn a thin film of cold air to keep the metal temperatures within acceptable ranges, (typically below 1600° F.). Such a gas turbine combustor is described in an article appearing in the 1986 International Gas Research Conference Reports, pgs. 126–139.

Testing of this prior art combustor showed that low NOx emissions could be obtained, but only over a very narrow range of burner stoichiometries. As the stoichiometry was progressively leaned (more and more excess air added to the fixed fuel flow), NOx levels dropped to low levels (below 10 ppm at 15% oxygen), but further leaning resulted in "blow out" in the combustor. The flame became unstable, and combustion ceased. The range between low NOx operation and blow-out was only about 7% indicating that for this design-stable operation together with low NOx could only be obtained by operating very near the lean blow-out limit.

The maximum turndown available with this prior art combustor is the difference between the maximum fuel flow that produces low NOx, and the minimum fuel flow that produces blow-out. Since this is only 7%, the amount of turndown is limited to 7%. Conventional gas turbines require a turndown of about 70% in order to operate over the power range from idle to full power.

Other researchers have constructed and operated lean premix gas turbine combustors with stability enhanced through the use of pilot ignition sources. The combustor system employs a plurality of burners at one end of a cooled metal wall combustion chamber all pointing axially thereof and each combining a lean premix swirled burner with a pilot burner located at the middle of the lean premix burner. At full power, nearly all the fuel is directed to the lean premix combustor. As the fuel flow is reduced from maximum (that is, as the overall Equivalence Ratio is decreased), a pilot burner of conventional design is increased in intensity (heat release) to keep the overall burner combustion stable. As the lean premix burner fuel flow is decreased, the pilot fuel flow is increased.

At some point, the lean premix portion of the burner can no longer be maintained in a stable combustion regime. At this point, the premix burner fuel flow is terminated, and the pilot fuel flow becomes the total fuel flow to the engine, and sustains the engine operation at reduced power settings. Because the pilot is not a low NOx design (necessary because it must operate over a wide range of heat release rates), the NOx emissions increase as pilot fuel flow is increased, and the engine is unable to maintain its low NOx emissions except near full power settings. This latter prior art gas turbine combustor is disclosed in a paper titled: "Premixing Gas and Air to Reduce NOx Emissions with Existing Proven Gas Turbine Combustion Chambers", presented at the International Gas Turbine Converence and Exhibit in Dusseldorf, West Germany, Jun. 8–12, 1986 and published by the American Society of Mechanical Engineers.

It is also known from the prior art to provide a staged lean premix low NOx gas turbine combustor employing a cold combustion wall. In such a combustor, it is known to turndown the total heat release of the gas turbine combustor by holding the heat release in the first stage at its maximum value consistent with low NOx emission while decreasing the heat release in the second stage by decreasing the Equivalence Ratio of the inducted lean mixture of fuel and compressed air inducted into the second stage of the combustor.

Such a combustor is described in a text titled: "Gas Turbine Combustion", published by Hemisphere Publishing Corp., 1983, pgs. 492–498. In this staged combustor, it was noted that the combustor emitted excess smoke and the turndown range was not mentioned.

It would be desirable to extend the Equivalence Ratio range over which a lean premix gas turbine combustor is operable while keeping NOx emissions acceptably low (preferably below 10 ppm corrected to 15% oxygen in the exhaust). This is equivalent to extending the operation of the gas turbine combustor over a broader range of heat releases (and, thus, a broader range of gas turbine power settings) while maintaining low NOx emissions throughout the power range.

SUMMARY OF THE PRESENT INVENTION

The principal object of the present invention is the provision of an improved staged low NOx lean premixed gas turbine hot wall combustor.

In one feature of the present invention, a plurality of streams of lean premixed fuel and compressed air are inducted into a stage of the combustion chamber, disposed downstream of another stage, from generally opposite directions and such streams being collided in an impact region to produce a divergent intensely turbulent flow emanating from the impact region to define a stirred reactor region of the combustion chamber, whereby combustion is maintained in the second stage region while avoiding hot spots and excessive generation of thermal NOx.

In another feature of the present invention, the flow of combustion products exiting the stirred reactor region are drifted and rectified to define a region of generally plug flow within the combustion chamber, whereby the entire flow is held at an appropriately high temperature for an appropriate period of time to assure that all of the carbon monoxide molecules and fuel molecule fragments are permitted to combust thereby assuring that the levels of carbon monoxide will be low at the combustor exit.

In another feature of the present invention, the output flow of a plurality of separate premixers is directed tangentially into an annular manifold at the end of the combustion chamber to produce a cyclonic flow of the premixture in the first stage of the combustion chamber to assist in formation of a recirculation zone which feeds hot combustion products from subsequent combustion stages back into the ignition region of the first combustion zone, thereby stabilizing the flame in the first stage of the combustor.

In another feature of the present invention, the plurality of lean premixture streams inducted into the second stage of the combustion chamber, are angled toward an upstream stage of the combustor to cause a portion of the second premixture to flow into the recirculation zone at the first stage of the combustion chamber, thereby providing a control over the amount of fresh reactants from the second stage that are ignited by and burned together with the first stage reactants.

In another feature of the present invention, a plurality of streams of a lean premixture of fuel and compressed air are inducted into a stage of the combustor downstream of an earlier stage, said streams being inducted with a substantial component of velocity directed tangentially to the axis of revolution of the combustion chamber so as to induce a cyclonic flow of the lean premixture in the combustion chamber.

In another feature of the present invention, a plurality of streams of lean premixed fuel and compressed air are inducted into a downstream stage of the combustion chamber with a substantial component tangential to the axis of revolution of the chamber to produce counter rotating cyclonic flow patterns in the upstream and downstream stages of the combustion chamber, whereby the level of turbulence is increased for improved combustion within the combustion chamber.

Other features and advantages of the present invention will become apparent upon a perusal of the following specification taken in connection with the accompanying drawings wherein:

DESCRIPTION OF THE PREFERRED EMBODIMENTS

Figure 1:
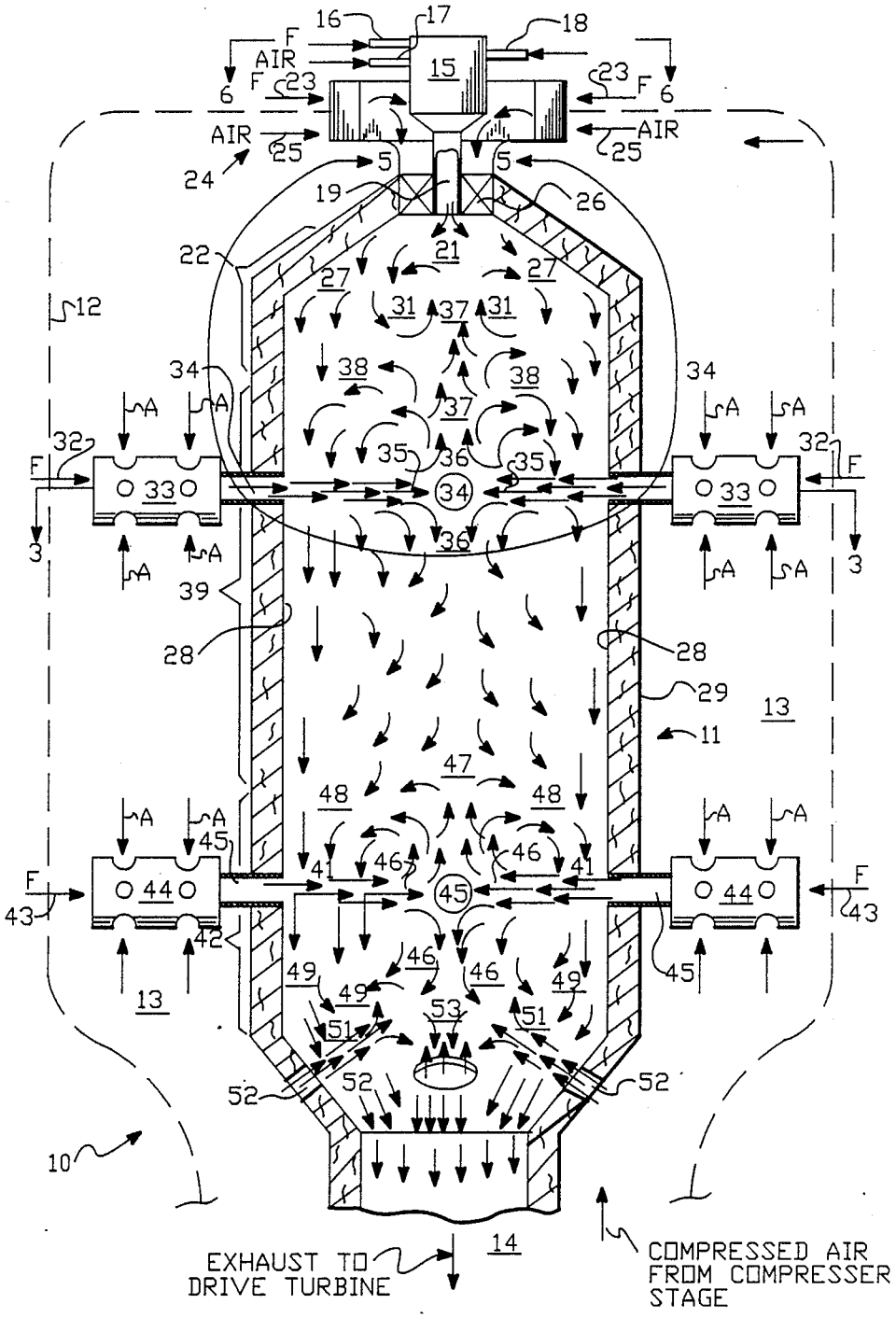
FIG. 1 is a longitudinal sectional view, partly schematic, of a staged gas turbine combustor employing features of the present invention.

Referring now to FIG. 1, there is shown a gas turbine combustor 10 incorporating features of the present invention. The combustor 10 includes a hollow, cylindrical combustion chamber 11 coaxially disposed within a generally cylindrical pressure vessel 12. An annular space 13 between the inside wall of the pressure vessel 12 and the outside wall of the combustion chamber 11 serves as a compressed air distribution manifold coupled in gas communication with the output of the compressor stage, not shown, of the gas turbine. Compressed air at between 4 and 40 atmospheres is supplied to the annular manifold 13. The exhaust gas of the combustion chamber at port 14 is connected in gas communication with the turbine for driving the turbine stage.

Air flow through the combustor 10 is approximately constant over the full range of heat release corresponding to the air flow in a gas turbine which changes its speed little from idle to full power conditions. Because the air flow is approximately constant, only the fuel flows are controlled within the combustor 10.

Initially, the turbine is turned over with a starter motor to establish the initial air flow. Fuel flow is admitted to an igniter 15 at 16 where it is mixed with igniter air flow 17 and ignited by a spark plug 18 energized by an external ignition source, not shown. Once ignition is established, the resulting flame is directed down an igniter tube 19 into an ignition zone 21 within a first stage 22 of the combustion chamber 11. Once ignition is established by the igniter 15, fuel flow at 23 is admitted to a lean premixer 24 where it is thoroughly mixed with first stage air flow admitted at 25.

Next, the mixed compressed air and fuel enters a swirl vane 26 which creates a swirling flow condition such that the flow exiting the swirler 26 has a high level of swirl. Swirl is characterized by its Swirl Number which is the ratio of the efflux of angular momentum divided by the efflux of axial momentum. Preferably, the swirl vanes 26 will create a flow having a Swirl Number of 0.7 or greater at the point where the flow enters the combustion chamber.

When the flow from the premixer 24 enters the combustion chamber 11, it is ignited by the flame from the igniter 15 and combustion is established in a region 27 along the upper conical surface of the combustion chamber 11. To obtain the optimum flame stability, the inside wall of the combustor 11 is preferably lined with a liner 28 made of an insulating low-density refractory material.

The refractory lining 28 is preferably formed by passing a slurry of alumina and silica fibers through a screen form, the size and shape of the chamber wall, causing the fibers to be caught on the screen to form a felt-like material. In a typical example, the refractory fibers are made of alumina and silica and coated with a binding material. The felt liner is then fired to a sufficiently high temperature to bind the structure together and then it is wrapped with a thin flexible layer of fibrous, thermally insulative material, to allow for relative movement between the liner 28 and the outer wall of the chamber 11 and inserted into the metallic outer wall 29 of the chamber. The result is a refractory, ceramic, fibrous lining approximately 1" thick and having approximately 90% void space. This will allow the refractory lining 28 to be rapidly thermally cycled with turn-off and turn-on of the combustor 10 without inducing cracking and spalling of the refractory lining 28.

The level of swirl and inclination of the top of the combustor 11 are selected so as to create a recirculation zone 31 which feeds hot combustion products from the outer wall region of flow 27 back into the ignition region 21 thereby stabilizing the flame in the first stage 22 of the combustor 11. Once the flame in the first stage 22 is stabilized, the igniter 15 is stopped by terminating the igniter fuel flow at 16. The heat release in the first stage 22 is selected to correspond to the required heat release needed to sustain the turbine at idle power. Once sufficient turbine speed is attained to permit the turbine to self-sustain its continued operation at idle power, the power to the turbine starter motor is terminated and the turbine operation becomes self-sustaining.

To increase the level of heat release, a fuel flow at 32 is admitted to fuel/air lean premixers 33 which uniformly mix the air and fuel prior to directing it into the combustion chamber 11 through second stage inlet ports 34. These ports 34 cause the mixture to flow in jets 35 which impinge generally head-on with one another in a central zone 36 which is characterized by extremely high levels of mixing and turbulence. A portion of the flow emanating from the impinging region 36 flows upstream to a region 37 where some of the flow is entrained in the first stage recirculation zone 31, and a portion recirculates out to the wall of the combustion chamber 11 to be carried downstream in flow region 38. The result of this mixing process is that the high temperature combustion products from the first stage cause the fuel in the second stage 39 to ignite and combust when combustion is initiated and maintained in the second stage region 39.

As fuel flow at 32 is increased, the temperature in the second stage region 39 is increased until the maximum desired temperature is obtained. This temperature will generally be at or below 2600° F. to inhibit the formation of thermal NOx in the second stage combustion region 39. Flow of combustion products from the first and second stage 22 and 39 are mixed and flow downstream roughly parallel to the axis of revolution of the combustion chamber 11. Thence, the flow encounters the penetrating jets 41 of a third combustion stage 42. Additional heat release is supplied to the combustion chamber 11 by admitting a third stage fuel flow at 43 to a lean premixer 44 which directs the lean premixer through ports 45 as jets 41. The jets 41 impinge near the center of the combustor in a region 46 which is characterized by intense mixing and high levels of turbulence. The portion of the impinging flow moves upstream to create a stagnation region 47 wherein the flow from the third and second stages 42 and 39, respectively, are intensely mixed. The hot combustion products from the second stage 39 ignite the fuel contained in jets 41 thus initiating and sustaining the third stage combustion in region 42. The flow moves parallel to the combustor wall in region 48 and enters a region 49 where the balance of the fuel is burned, and wherein the time average flow is characterized as being generally parallel to the combustor walls.

The hot combustion products from all three stages 22, 39 and 42 exit region 49 to encounter dilution air flow 51 which flows through dilution airports 52 to form the dilution air jets 51. These jets 51 plunge into the combustor flow and impinge on one another in a region 53 which is characterized by a high level of mixing and turbulence. The objective of permitting the dilution air to enter the combustion chamber is to reduce the combustion exit temperature at region 14 from a maximum temperature as high as 2600° F. to a lower temperature in the range of typically 1500° F. to 2300° F. which is the maximum tolerable in the turbine nozzle and turbine wheel sections of the turbine engine. The dilution air flow lowers the temperature, and the turbulence created by the impinging jets 51 insures a good mixing so that a uniform temperature distribution is developed at the combustor exit plane 14.

Figure 2:
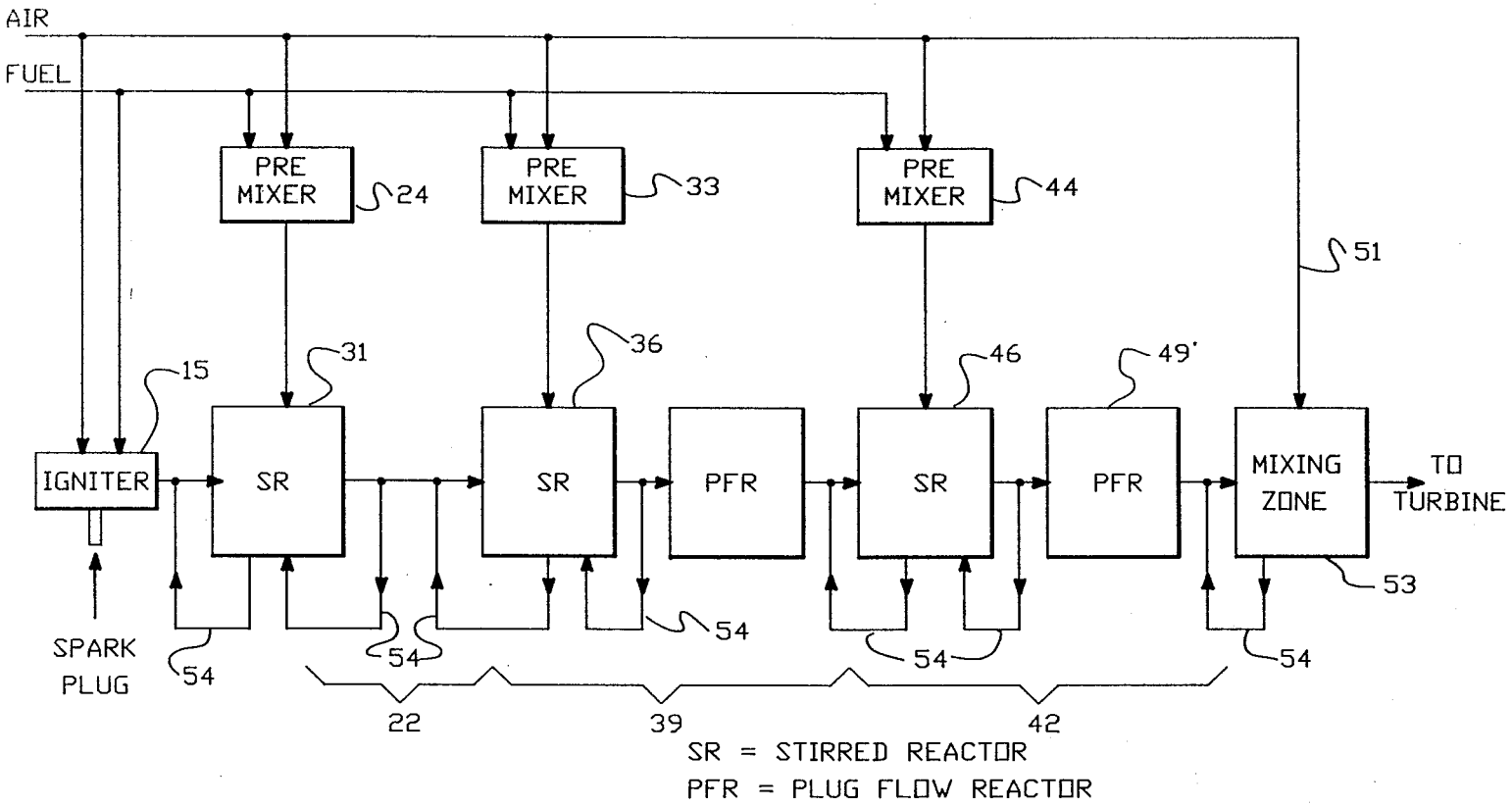
FIG. 2 is a schematic block diagram of the combustor of FIG. 1.

Referring now to FIG. 2, there is shown, in schematic form, the operation of the three-stage combustor 11 described with regard to FIG. 1. To describe the diagram of FIG. 2, two concepts are first needed. The first is the Well Stirred Reactor (designated as SR in FIG. 2) which is a theoretical model of a chemical reactor having a very high degree of mixing such that the concentration of chemical species throughout the well Stirred Reactor region is uniform. Well stirred reactors are characterized by extremely high levels of turbulence which has been found experimentally to be beneficial in igniting and maintaining the combustion of very lean fuel/air combustible mixtures. Further, because of the high level of mixing that occurs, some of the chemical reactants exit the Stirred Reactor region immediately while some are retained for a relatively long period of time. Thus the residence time that each molecule spends in a Stirred Reactor Region can be represented as a distribution ranging from very short to comparatively long times (compared to the average residence time).

The second useful concept is that of the Plug Flow Reactor designated as PFR in FIG. 2. The Plug Flow Reactor region is a region where all the reactants move roughly in parallel with one another and roughly parallel to the axis of the reactor/combustor 11 such that each molecule is exposed to approximately the same residence time in the Plug Flow Reactor region. It has been determined that in combustion systems, slowly combusting fuel molecule fragments and combustion products such as carbon monoxide burn at a relatively slow rate, and, thus, the entire flow must be held at an appropriately high temperature for an appropriate period of time to assure that all of the carbon monoxide molecules and fuel molecule fragments are permitted to combust, thereby assuring that the levels of carbon monoxide will be low at the combustor exit.

The staged lean premix combustor 11 can thus be seen to consist of a series of stages (or combustor regions) which are comprised by a well Stirred Reactor region (for flame stability at ignition of lean fuel/air mixtures) followed by a Plug Flow Region to permit the burnout of slower burning chemical species. Fuel-/air mixtures are generated in premixers 24, 33 and 44 and admitted to the Stirred Reactor regions 31, 36, and 46, respectively, of each combustion stage 22, 39 and 42. Because of the flow patterns within and between the Stirred Reactor and Plug Flow Regions, there are various feedback paths 54 around each of the stirred reactor regions; and around the mixing zone. The flow exiting the third stage Plug Flow Reactor 49 then enters the mixing zone 53 created by the dilution air jets 51 and the mixed flow reduced in temperature by the dilution air, exits the combustor 11 to enter the turbine stage of the gas turbine engine.

Figure 3:
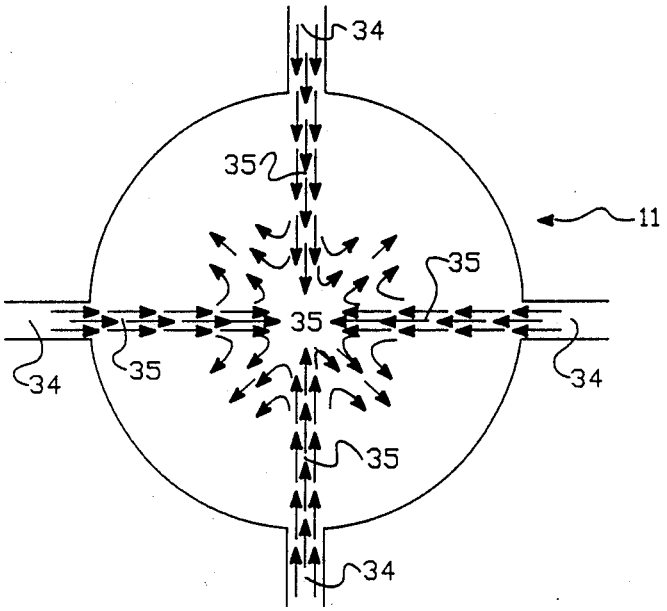
FIG. 3 is a schematic sectional view of a portion of the structure of FIG. 1 taken along line 3—3 in the direction of the arrows.

FIG. 3 shows a sectional view through a combustor 11 as taken along line 3—3 in the direction of the arrows. The jets 35 are directed at one another to collide head-on to create a stagnation region 36 in the center of the combustor 11, a region that will be characterized by very high levels of mixing and turbulence.

Figure 4:
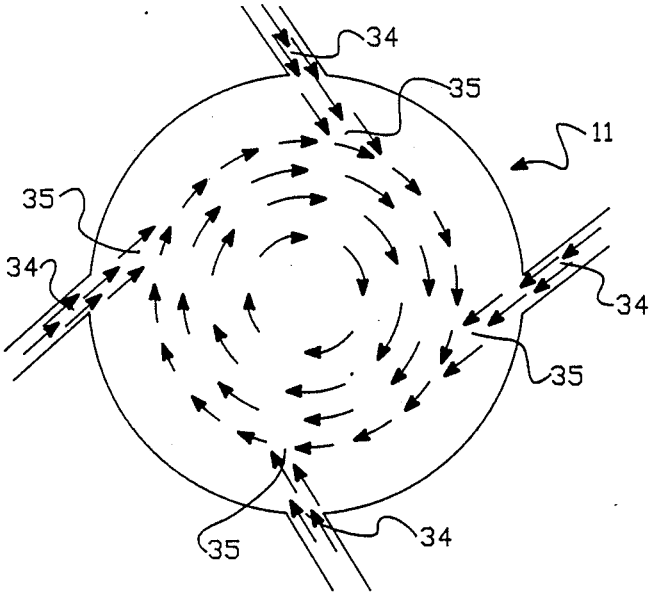
FIG. 4 is a view similar to that of FIG. 3 depicting an alternative embodiment of the present invention.

Referring now to FIG. 4, there is shown an alternative to the embodiment of FIG. 3 wherein the jets 35 are angled relative to the axis of revolution of the combustion chamber 11 so as to have a substantial tangential inlet velocity component, thereby creating a swirling flow pattern as shown. The swirling component of velocity can be arranged to be either opposite to the swirl of the first stage 22 (creating a counter-swirl condition) or in the same direction of the swirl of the first stage 22 (creating a co-swirl condition). Counter swirl is used to increase the level of turbulence or to effectively nullify the residual swirl from the first stage, thereby creating a more Plug Flow-like flow down-stream of the jets 35. Co-swirl is useful to increase the velocity near the wall of the combustor and to increase the distribution of turbulent energy such that more turbulent energy is near the wall surface which is useful to improve flame stability under some conditions.

Figure 5:
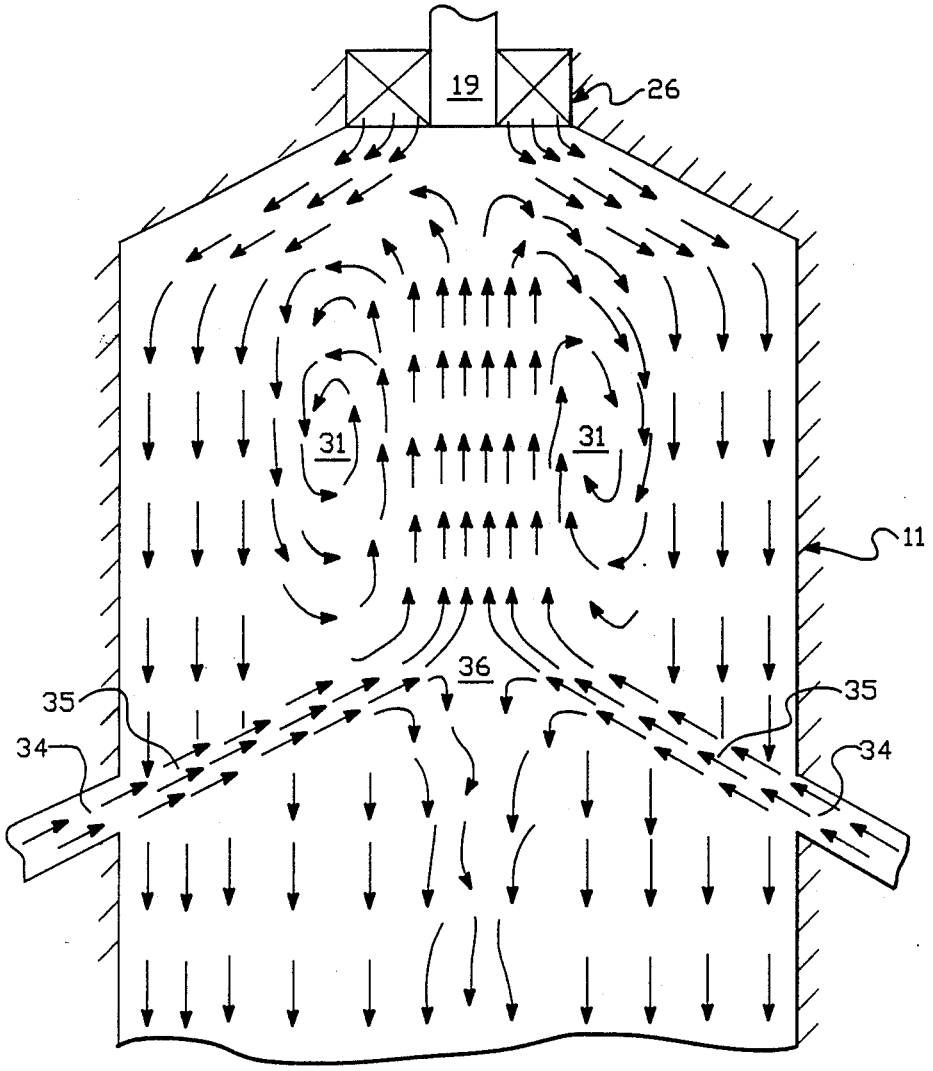
FIG. 5 is a detail view of a portion of the structure of FIG. 1 delineated by line 5—5 and depicting an alternative embodiment of the present invention.

Referring now to FIG. 5, there is shown an alternative embodiment to that portion of the structure of FIGS. 3 and 4. In the embodiment of FIG. 5, inlet ports 34 are inclined relative to the axis of revolution of the cylinder toward the first stage swirler 26. This alters the flow in the stagnation region 36 such that more of the total flow through ports 34 is directed towards the first stage recirculation zone 31 and less is directed downstream towards the third stage combustion region 42. Modification of flow as illustrated in FIG. 5 allows a greater proportion of the fuel/air mixture from the second stage mixers 33 to flow into the combustion region of the first stage 22 and, thus, provides some control over the amount of fresh reactants from the second stage mixers 33 that are ignited by and burned together with the first stage reactants. Inclining the inlet ports 34 of the second stage 39, or any subsequent stage such as stage 42, thus serves as an adjustment to optimize the performance of the combustor 11.

Figure 6:
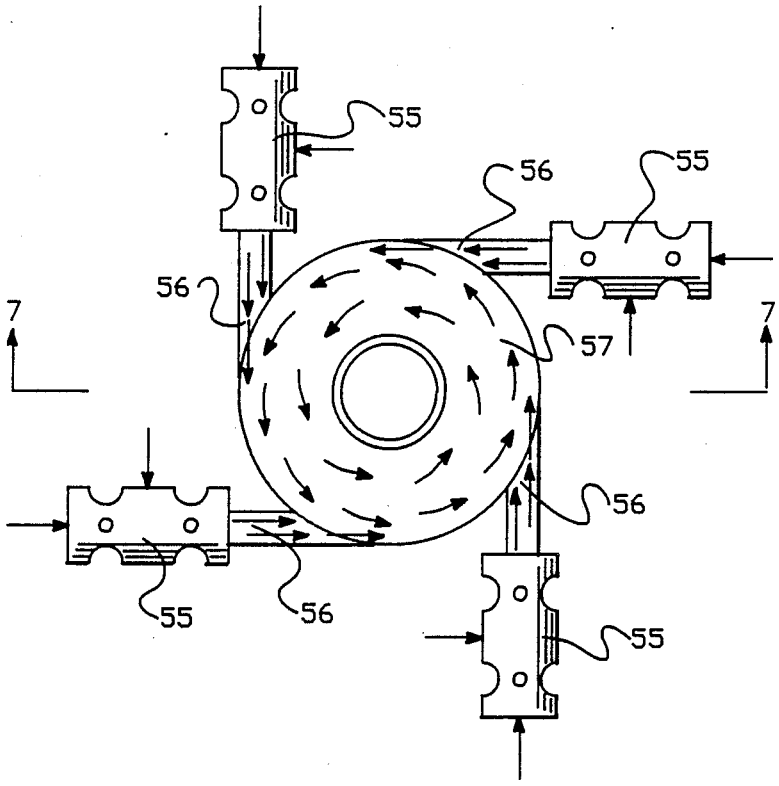
FIG. 6 is a sectional view of the structure of FIG. 1 taken along line 6—6 in the direction of the arrows and depicting an alternative embodiment of the present invention.
Figure 7:
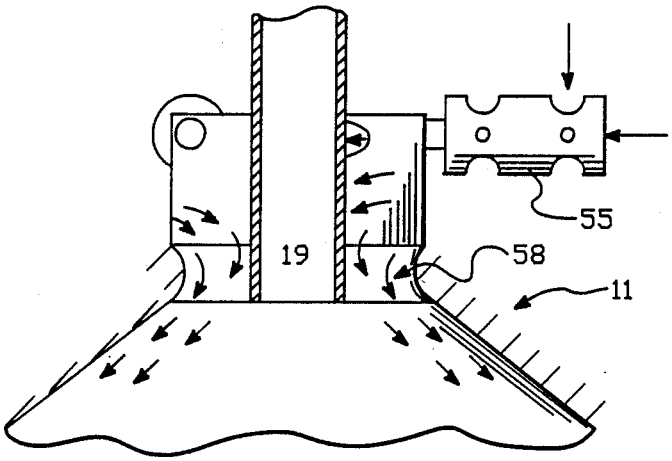
FIG. 7 is a sectional view of the structure of FIG. 6 taken along line 7—7 in the direction of the arrows.

Referring now to FIGS. 6 and 7, there is shown an alternative embodiment to the first stage swirler/mixer embodiment of FIG. 1. More particularly, air and fuel is thoroughly mixed in a plurality of lean premixers 55 of the type previously described with regard to FIG. 1 at 33 and 44. The exits ports 56 of the mixers 55 are directed tangentially into an annular swirler chamber 57 where the flow has a high degree of tangential velocity. The flow circles around the igniter tube 19 and downward through a throat 58 into the top zone of the combustion chamber 11. The high level of swirl that results creates the desirable recirculation zone 31 of FIG. 1. The throat 58 functions to accelerate the flow such that the combustion process in the first combustion stage 22 cannot "flashback" towards the mixers 55, thereby permitting the flame to anchor within the combustion chamber. The cross-sectional area of the throat 58 is selected to permit a mixture velocity that is comfortably higher than the peak flame propagation velocity. Because the mixers 55 thoroughly mix the fuel and air, and because the fuel/air mixture is very lean in order to reduce the formation of thermal NOx, the flame propagation velocity is comparatively low (low relative to the flame propagation velocity that would obtain if the fuel/air mixture were close to stoichiometric). Thus, the combination of lean fuel/air mixture and high velocity in the throat 58 combine to assure the flashback will not take place.

Figure 8:
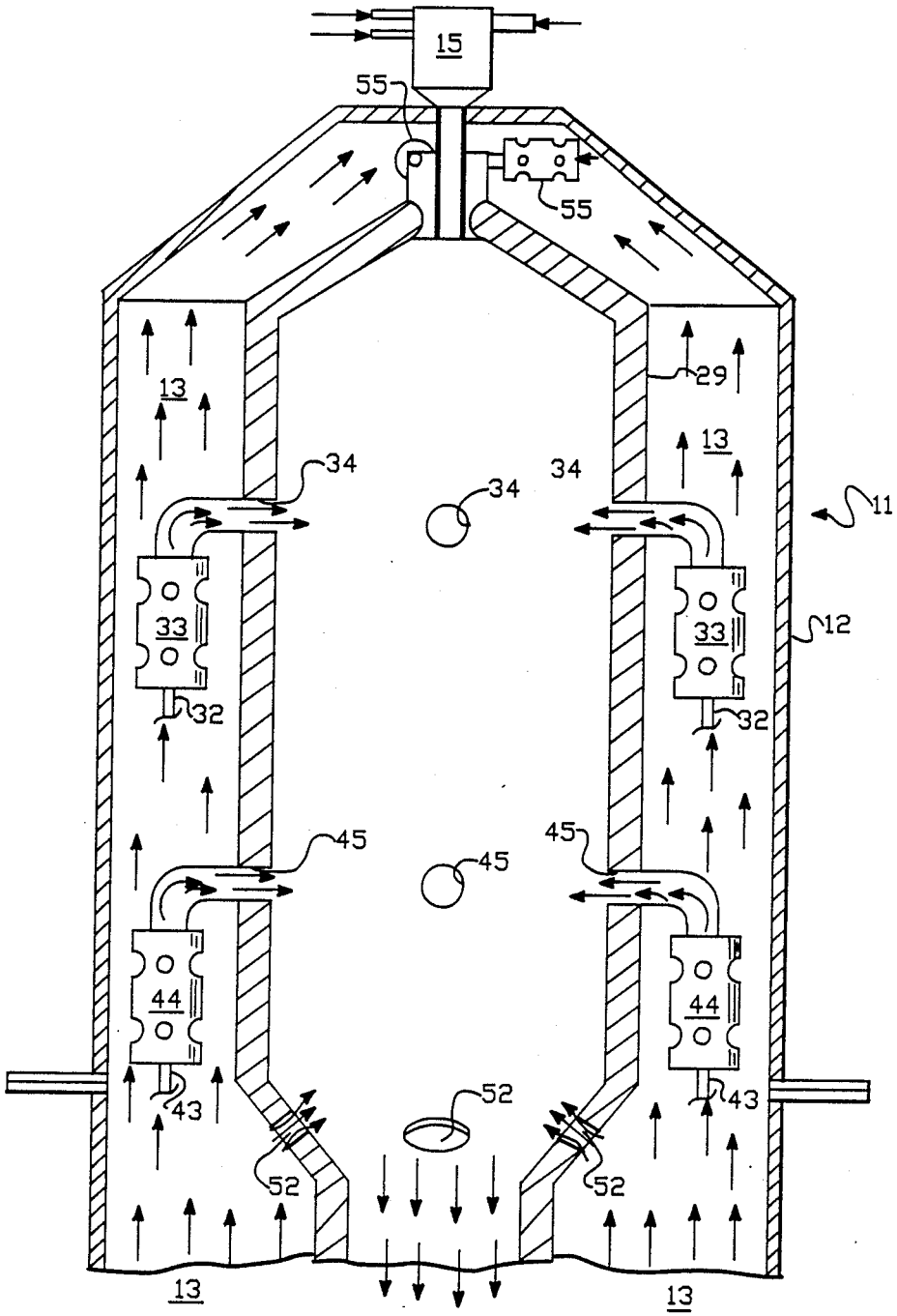
FIG. 8 is a sectional view similar to that of FIG. 1 depicting an alternative embodiment of the present invention.

Referring now to FIG. 8, there is shown a typical physical realization of the gas turbine combustor 11 incorporating features of the present invention. The pressurized compressed air from the compressor stage is contained by use of a pressure vessel 12. Air flows from the turbine compressor to the annular inlet 13 of the pressure vessel 12 and upward in the annular space between the combustor wall 29 and the pressure vessel 12. A portion of the air flows through the dilution air ports 52 while the balance flows upward in the annular space 13. Air enters the third and second stage mixers 44 and 33, respectively, where air is mixed with fuel before flowing through the inlet ports 45 and 34 to the combustor interior. Air that does not flow into the third and second stage mixers flows to the top of the combustor assembly and into the first stage mixers 55. The igniter 15 is located on the top of the combustor 11 on its axis of revolution and can easily be maintained or replaced because of its external location.

The thermally insulative lining 28 for the combustion chamber 11 has a low coefficient of thermal conductivity such as less than 10 BTU-in./ft$^2$/° F. and preferably closer to 1 BTU-in/ft$^2$/° F. The lining 28 maintains its inside wall temperature near the flame temperature, i.e., within 200° F. and preferably within 50° F. Suitable refractory lining materials have densities on the order of 22 pounds per cubic foot.

The advantages of the staged lean premixed gas turbine combustor 11 of the present invention include low NOx emission over a wide range of turndown such that the combustor provides a high degree of flame stability over its wide operating range of heat release values.

What is claimed is:

1. In a staged low NOx lean premix hot wall method for combusting fuel in a gas turbine combustor, the steps of:

inducting a first lean premixture of fuel and compressed air into a first stage of a combustion chamber;

igniting and combusting the inducted first premixture of fuel and air within the first stage of the combustion chamber to produce a stream of combustion products exiting the first stage of the combustion chamber;

inducting a plurality of streams of a second premixture of fuel and compressed air into a second stage of the combustion chamber downstream of the first stage from generally opposite directions and colliding the streams in an impact region within the stream of combustion products exiting the first stage of the combustion chamber to produce a divergent intensely turbulent flow emanating from the impact region to define a Stirred Reactor region within the second stage of the combustion chamber;

igniting and burning the second lean premixture of fuel and compressed air in the second stage of the hot wall combustion chamber to produce combustion products exiting the second stage of the combustion chamber; and maintaining the interior wall surface of the combustion chamber which faces the combustion flame at a temperature near the flame temperature within the combustor, whereby high stability low NOx operation is obtained over a wide range of turndown heat release values.

2. The method of claim 1 including the step of:

directing the flow of combustion products exiting the Stirred Reactor region of the second stage of the combustion chamber to define a region of generally Plug Flow of combustion products within the second stage of the combustion chamber downstream of the Stirred Reactor region thereof.

3. The method of claim 1 wherein the step of inducting the first lean premixture of fuel and compressed air into the first stage of the combustion chamber includes the step of:

directing the output flow of a plurality of separate premixers tangentially into an annular manifold at the end of the combustion chamber to produce a cyclonic flow of the premixture in the manifold; and inducting the cyclonic flow from the manifold into the first stage of the combustion chamber to provide a cyclonic flow of the lean premixture in the first stage of the combustion chamber.

4. The method of claim 1 wherein the fuel is natural gas consisting of a preponderance of methane.

5. The method of claim 1 including the step of recirculating the flow of combustion products within the first stage of the combustion chamber to define a zone of recirculation therein wherein the direction of flow is counter to the flow of the inducted first lean premixture.

6. The method of claim 1 wherein the colliding streams of inducted second lean premixture are collided generally head-on.

7. The method of claim 5 wherein the collided streams of inducted second lean premixture in the second stage are angled toward the upstream first combustion stage to flow a portion of the second premixture from the second stage into the recirculation zone of the first stage of the combustion chamber.

8. In a staged low NOx lean premix hot wall method for combusting fuel in a gas turbine combustor, the steps of:

inducting a first lean premixture of fuel and compressed air into a first stage of a combustion chamber;

igniting and combusting the inducted first premixture of fuel and air within the first stage of the combustion chamber to produce a stream of combustion products exiting the first stage of the combustion chamber;

inducting a plurality of streams of a second premixture of fuel and compressed air to a second stage of the combustion chamber downstream of the first stage with a substantial component of velocity directed tangentially to the axis of revolution of the combustion chamber so as to induce a cyclonic flow of the second premixture in the second stage of the combustion chamber;

igniting and burning the second lean premixture of fuel and compressed air in the second stage of the hot wall combustion chamber to produce combustion products exiting the second stage of the combustion chamber; and maintaining the interior surface of the wall of the combustion chamber which faces the combustion flame at a temperature near the flame temperature within the combustor, whereby low NOx emissions are obtained over a wide range of heat release values.

9. The method of claim 8 wherein the step of inducting the first lean premixture of fuel and compressed air into the first stage of the combustion chamber includes the step of:

directing the output flow of a plurality of separate premixers tangentially into an annular manifold at the end of the combustion chamber to produce a cyclonic flow of the premixture in the manifold; and inducting the cyclonic flow from the manifold into the first stage of the combustion chamber to produce a cyclonic flow of the lean premixture in the first stage of the combustion chamber.

10. The method of claim 9 wherein the first and second premixtures are inducted into the first and second stages of the combustion chamber so as to produce counter-rotating first and second cyclonic flow patterns in the first and second stages of the combustion chamber.

11. In a staged low NOx lean premix hot wall gas turbine combustor having a combustion chamber with first and second stage regions:

first inducting means for inducting a first lean premixture of fuel and compressed air into the first stage of the combustion chamber;

igniter means for igniting and combusting the inducted first premixture of fuel and air within the first stage of the combustion chamber to produce a stream of combustion products exiting the first stage of the combustion chamber;

second inducting means for inducting a plurality of streams of a second premixture of fuel and compressed air into the second stage of the combustion chamber downstream of the first stage from generally opposite directions and colliding the streams in an impact region within the stream of combustion products exiting the first stage of the combustion chamber to produce a divergent intensely turbulent flow emanating from the impact region to define a Stirred Reactor region within the second stage of the combustion chamber within which the second lean premixture of fuel and compressed air is ignited and burned to produce combustion products exiting the second stage of the combustion chamber; and thermal insulation means for maintaining the interior wall surface of the combustion chamber which faces the combustion flame at a temperature near the flame temperature within the combustor, whereby high stability low NOx operation is obtained over a wide range of turndown heat release values.

12. The combustor of claim 11 including:

Plug Flow means for directing the flow of combustion products exiting the Stirred Reactor region of the second stage of the combustion chamber to define a region of generally Plug Flow of combustion products within the second stage of the combustion chamber downstream of the Stirred Reactor region thereof.

13. The combustor of claim 11 wherein said first inducting means includes:

directing means for directing the output flow of a plurality of separate premixers tangentially into an annular region at the end of the combustion chamber to produce a cyclonic flow of the premixture in the annular region; and throat means for inducting the cyclonic flow from said annular region into the first stage of the combustion chamber to provide a cyclonic flow of the lean premixture in the first stage of the combustion chamber.

14. The combustor of claim 11 wherein the fuel is natural gas consisting of a preponderance of methane.

15. The combustor of claim 11 including recirculating means for recirculating the flow of combustion products within the first stage of the combustion chamber to define a zone of recirculation therein wherein the direction of flow is counter to the flow of the inducted first lean premixture.

16. The combustor of claim 11 wherein the colliding streams of inducted second lean premixture are collided generally head-on.

17. The combustor of claim 15 wherein said recirculating means includes directing means for angling the collided streams of inducted second lean premixture in the second stage toward the upstream first combustion stage to flow a portion of the second premixture from the second stage into the recirculation zone of the first stage of the combustion chamber.

18. In a staged low NOx lean premix hot wall gas turbine combustor having a combustion chamber with an axis revolution and first and second combustion stages:

first stage inducting means for inducting a first lean premixture of fuel and compressed air into the first stage of the combustion chamber;

igniter means for igniting and combusting the inducted first premixture of fuel and air within the first stage of the combustion chamber to produce a stream of combustion products exiting the first stage of the combustion chamber;

second stage inducting means for inducting a plurality of streams of a second premixture of fuel and compressed air into the second stage of the combustion chamber downstream of the first stage with a substantial component of velocity directed tangentially to the axis of revolution of the combustion chamber so as to induce a cyclonic flow of the second premixture in the second stage of the combustion chamber for burning the second lean premixture of fuel and compressed air in the second stage of the hot wall combustion chamber to produce combustion products exiting the second stage of the combustion chamber; and thermal insulation means for maintaining the interior surface of the wall of the combustion chamber which faces the combustion flame at a temperature near the flame temperature within the combustor, whereby low NOx emissions are obtained over a wide range of heat release values.

19. The combustor of claim 18 wherein said first stage inducting means includes:

an annular manifold at the end of the combustion chamber;

directing means for directing the output flow of a plurality of separate premixers tangentially into said annular manifold to produce a cyclonic flow of the premixture in the manifold; and throat means for inducting the cyclonic flow from said manifold into the first stage of the combustion chamber to produce a cyclonic flow of the lean premixture in the first stage of the combustion chamber.

20. The combustor of claim 19 wherein said first and second inducting means induct said premixtures into the first and second stages of the combustion chamber so as to produce counter-rotating first and second cyclonic flow patterns in the first and second stages of the combustion chamber.

* * * * *